US006082712A

United States Patent [19]

Cincotta et al.

[11] Patent Number: 6,082,712

[45] Date of Patent: Jul. 4, 2000

[54] DIRECT CONTACT STEAM INJECTION HEATER

[75] Inventors: Bruce A. Cincotta, Wauwatosa; Damon L. Fisher, Waukesha, both of Wis.

[73] Assignee: Hydro-Thermal Corporation, Waukesha, Wis.

[21] Appl. No.: 09/112,499

[22] Filed: Jul. 9, 1998

[51] Int. Cl.[7] ..... B01F 3/04

[52] U.S. Cl. ..... 261/76; 261/DIG. 10

[58] Field of Search ..... 261/76, 78.2, DIG. 10, 261/DIG. 76, DIG. 78

[56] References Cited

U.S. PATENT DOCUMENTS

| | | | |
|---|---|---|---|
| 1,315,931 | 9/1919 | Poppink | 261/DIG. 76 |
| 1,846,220 | 2/1932 | McCune, Jr. | 261/DIG. 76 |
| 2,483,426 | 10/1949 | Moore | 261/64 |
| 3,197,337 | 7/1965 | Schink | 261/76 |
| 3,331,590 | 7/1967 | Battenfeld et al. | 261/50 |
| 3,984,504 | 10/1976 | Pick | 261/76 |
| 4,198,357 | 4/1980 | Berriman et al. | 261/44 |
| 4,473,512 | 9/1984 | Pick et al. | 261/62 |
| 4,505,865 | 3/1985 | Wullenkord | 261/76 |
| 4,931,225 | 6/1990 | Cheng | 261/76 |
| 5,395,569 | 3/1995 | Badertscher et al. | 261/62 |
| 5,622,655 | 4/1997 | Cincotta et al. | 261/76 |

FOREIGN PATENT DOCUMENTS 201014 3/1907 Germany .

OTHER PUBLICATIONS

"Improving Efficiency and Productivity while Lowering Production Costs through Efficient Heating of Liquids and Slurries for Chemical Processing, Pharmaceutical Manufacturing", Hydro–Thermal Corporation, Bulletin H150.

"Efficient Steam Heating of Liquids and Slurries", Hydro–Thermal Corporation, Bulletin H120.

"Automatic Temperature Contorl" Hydro–Thermal Corporation, Application Bulletin A–3.

"Hot Liquids on Demand", Hydro–Thermal Corporation Form H112.

"Automatic Intermittent Heating", Hydro–Thermal Application Bulletin A–11.

*Primary Examiner*—David A. Simmons
*Assistant Examiner*—Robert A. Hopkins
*Attorney, Agent, or Firm*—Andrus, Sceales, Starke & Sawall

[57] ABSTRACT

A direct contact steam injection heater includes a Mach diffuser having a plurality of steam diffusion holes in lieu of a coaxial steam nozzle. High velocity steam (i.e. choked flow) flows radially through the plurality of steam diffusion holes into a high velocity axial flow of liquid through a combining tube within the heater. An adjustably positionable cover over the steam diffusion holes in the Mach diffuser modulates the amount of steam added to the liquid by exposing the proper number of steam diffusion holes. This modulation is done at constant steam pressure without the use of an external steam control device. The arrangement facilitates thorough mixing of steam and liquid within the combining region. It also discourages the generation of relatively large steam bubbles within the mixture, even when heating liquids that promote the generation of relatively large steam bubbles such as liquids without a significant number or nucleation points or without sufficient surface tension. Upon condensation of steam in the heater, relatively large steam bubbles tend to cause vibrations in the heater and adjacent plumbing. The invention substantially eliminates this source of vibrations.

29 Claims, 3 Drawing Sheets

DIRECT CONTACT STEAM INJECTION HEATER

FIELD OF THE INVENTION

The invention relates to direct contact steam injection heaters that use full pressure steam. In particular, the invention relates to an improvement for reducing heater vibrations that are prevalent when heating certain types of liquids.

BACKGROUND OF THE INVENTION

In direct contact steam injection heaters, steam is directly mixed with the liquid being heated, or in some cases with a slurry being heated. Direct contact steam injection heaters are very effective at transferring heat energy from steam to the liquid. They provide rapid heat transfer with virtually no heat loss to the atmosphere, and also transfer both the latent and the available sensible heat of the steam to the liquid.

The present invention was developed during ongoing developmental efforts by the assignee in the field of direct contact steam injection heaters. U.S. Pat. No. 5,622,655 entitled "Sanitary Direct Contact Steam Injection Heater And Method" by Bruce A. Cincotta et al., issuing on Apr. 22, 1997, and allowed U.S. patent application Ser. No. 08/650,648, now U.S. Pat. No. 5,842,497, entitled "Adjustable Direct Contact Steam Injection Heater", by Brian Drifka and Bruce A. Cincotta, filed on May 28, 1998, represent some of the prior developments in direct contact steam injection heaters by the assignee, and are hereby incorporated by reference.

These types of direct contact steam injection heaters use full pressure steam (i.e. the full amount of steam pressure available), and modulate the amount of steam added to the liquid for heating purposes by a nozzle and plug configuration. The steam exits through the nozzle under sonic choked flow conditions. The high speed steam from the nozzle shears the liquid into droplets, and creates a homogeneous blend of steam and liquid in a combining region located downstream of the nozzle. As heat is transferred to the liquid, the steam condenses.

Although direct contact steam injection heaters are efficient and effective, the heaters can vibrate heavily in certain specialized applications. It has been found that vibrations tend to occur when heating liquids in which steam bubbles in the mixture of liquid and steam merge to create larger bubbles of steam within the liquid before the steam condenses. The condensation of the large steam bubbles creates unwanted vibrations in the heater. This type of behavior has been noticed in liquids such as purified water (e.g. boiler feed water) which do not have a sufficient amount of nucleation points for bubble formation. It has also been noticed in liquids that do not have suitable surface tension to sufficiently atomize the liquid (e.g. oils).

SUMMARY OF THE INVENTION

The invention is a direct contact steam injection heater in which the steam is injected through a plurality of relatively small steam diffusion holes in a Mach diffuser into liquid flowing through the combining region in the heater. The combining region has an inlet for the liquid and an outlet for the heated liquid. The Mach diffuser is generally coaxial with and resides within the combining region inlet. Steam exits through the plurality of steam diffusion holes in the Mach diffuser, preferably radially, at a generally sonic velocity into the liquid flow. The small radial jets of steam into the axial flow of liquid through the combining region enhance mixing of the liquid and steam. In addition, the velocity of the liquid flowing through the channel between the Mach diffuser and the combining region is maintained at a relatively high velocity (i.e., a relatively small flow area in the channel compared to the downstream portion of the combining region). The high axial velocity of the liquid continually wets the outer surface of the Mach diffuser to prevent continuous enlarged steam bubbles from occurring. This combined with the thorough mixing of the small high velocity radial steam jets into the high velocity axial liquid flow discourages the formation of relatively large steam bubbles downstream in the combining region prior to condensation, and therefore substantially reduces heater vibrations.

The amount of steam discharged through the Mach diffuser into the liquid flowing through the combining region is modulated by adjusting the position of a cover over a selected amount of steam diffusion holes. The Mach diffuser preferably has a cylindrical wall containing the steam diffusion holes, and the cover is preferably a solid cylindrical wall located within the Mach diffuser cylindrical wall. The cover has an internal region that contains steam passing into the heater. The downstream end of the cover includes a steam outlet opening. When the cover is in the fully closed position, the cover completely covers all of the steam diffusion holes through the Mach diffuser and therefore prevents the flow of steam through the Mach diffuser into the flow of liquid in the combining region. When the cover is opened or partially opened, a generally proportional amount of steam diffusion holes in the Mach diffuser are exposed, and radial jets of steam flow through the exposed steam diffusion holes into the liquid flow through the combining region. The amount of steam discharged to heat the liquid is modulated by selectively positioning the cover.

Other features and advantages of the invention will be apparent upon inspecting the drawings and the following description thereof.

DETAILED DESCRIPTION OF THE DRAWINGS

Prior Art

Figure 1:
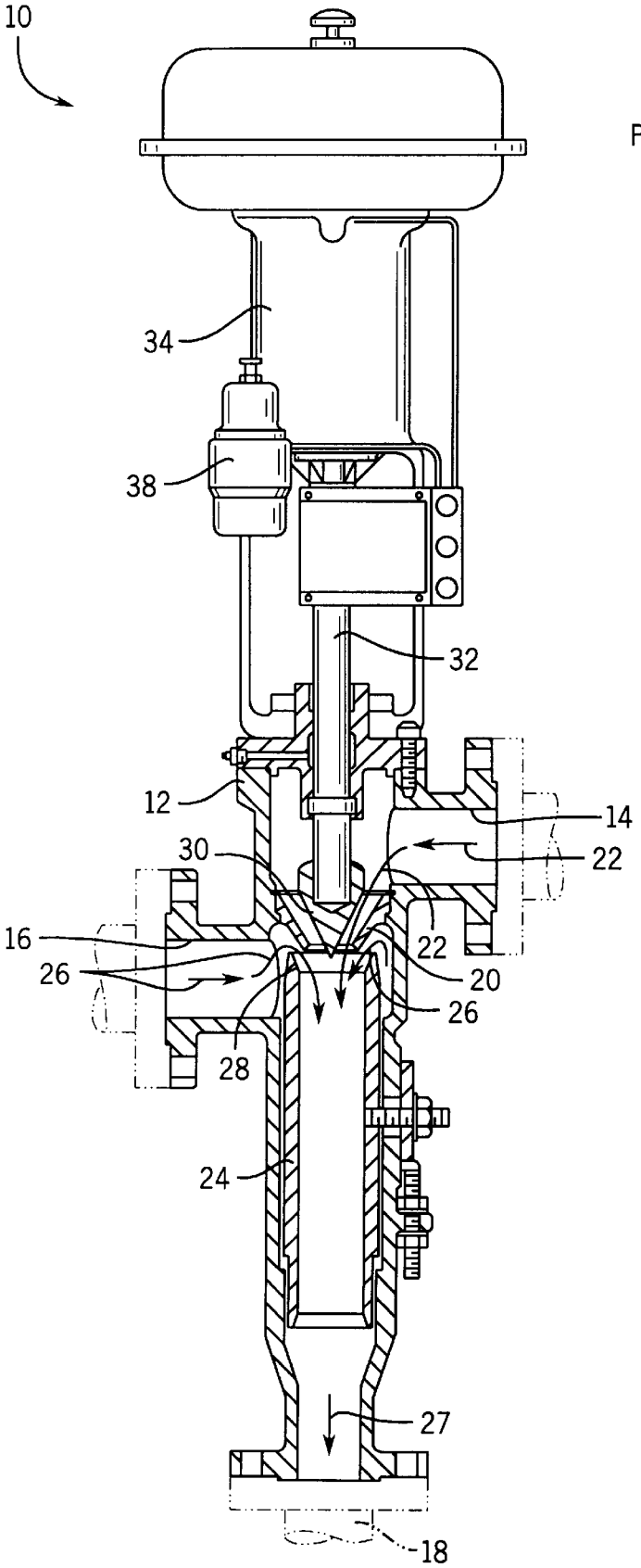
FIG. 1 PRIOR ART
FIG. 1 is a side elevational view showing a longitudinal cross-section of the direct contact steam injection heater having a plug-type steam nozzle in accordance with the prior art.

FIG. 1 shows a direct contact steam injection heater 10 in accordance with the prior art. The heater has a body 12 having a steam inlet 14, a liquid product inlet 16, and a heated liquid product discharge outlet 18. Steam flows into the heater 10 through the steam inlet 14, and then through a plug-type steam nozzle 20 as depicted by arrows 22. A liquid or slurry product that will be heated enters the heater 10 through the product inlet 16 and flows into a combining tube 24 as depicted by arrows 26.

Steam is typically supplied to the heater 10 at the full available steam pressure (e.g. 15 to 300 psig). The heater 10 is designed so that the flow of steam 22 through the nozzle 20 is choked such that the speed of the steam 22 exiting the nozzle is sonic or supersonic. The high velocity steam 22 shears the liquid 26 or slurry into tiny droplets and creates large surface area within the mixture to facilitate rapid and efficient heat transfer in the combining tube 24. The heated liquid product exits the heater body 10 through the liquid product discharge outlet 18 as depicted by arrow 27.

The combining tube 24 is a longitudinal tube slidably mounted within the heater body 12. The steam nozzle 20 is frustoconical nozzle that is located between the steam inlet 14 and an upstream end 28 of the combining tube 24. The steam nozzle 20 shown in prior art FIG. 1 discharges steam coaxially into the combining tube 24. An adjustably positionable plug 30 for the steam nozzle 20 is provided so that the amount of steam injected into the heater can be modulated. The plug 30 has a stem 32 that is controlled by an actuator 34 and a positioner 36. FIG. 1 also shows a filter regulator 38.

The upstream end 28 of the combining tube 24 is spaced away from the steam nozzle 20 a variable distance to form a passage for the liquid product flowing from the liquid product inlet 16 into the combining tube 24. The size of the passage is adjusted by adjusting the longitudinal position of the combining tube 24 within the heater body 12. The optimum distance between the steam nozzle 20 and the upstream end 28 of the combining tube 24 depends on product composition, flow rates, pressures and temperatures. U.S. patent application Ser. No. 08/650,648, now U.S. Pat. No. 5,842,497, entitled "Adjustable Shear Direct Contact Steam Injection Heater" by Brian N. Drifka and Bruce A. Cincotta, filed on May 20, 1996 and issuing on Dec. 1, 1998 discloses direct contact steam injection heaters in which the position of the combining tube 24 can be repositioned without taking the heater 10 off-line.

Most of the heat transfer from the steam 22 to the liquid 26 in the heater 10 is accomplished within the combining tube 24. Within the combining tube 24 the steam 22 is thoroughly mixed with the liquid product 26, and the steam condenses to transfer the latent heat of the steam 22 to the liquid 26 being heated. Therefore, in the heater 10 both latent and sensible heat of the steam 22 are transferred during high velocity mixing within the combining tube 24 to efficiently heat the liquid product 26. The amount of steam 22 required to provide the desired temperature of the heated liquid product 26 is controlled within the heater 10 by the position of the steam nozzle plug 30. The cone-shaped plug 30 resides within the nozzle 20 opening to vary the area of steam nozzle exit, and thus modulate the flow of steam 22 at the point where the steam 22 and the liquid 26 initially contact. To those skilled in the art, it should be apparent that the amount of steam flow is internally modulated within the heater 10, and there is no need under normal operating conditions to use a valve upstream of the heater 10 to turn down steam pressure in order to control the flow of steam through the nozzle 20.

Although the heater 10 works well in most applications, the heater 10 can vibrate excessively when used to heat liquid products 26 that have a composition which facilitates the conglomeration of steam bubbles within the combining tube 24 before condensation. Such liquids include, for example, purified water which does not provide a sufficient amount of nucleation points or liquids such as oils which do not have significant surface tension to maintain steam atomization within the mixture. In these types of liquids, the enlarged steam bubble conglomerates can cause excessive vibrations when the steam condenses within the combining tube.

Present Invention

The invention as illustrated in FIGS. 2–5 is designed to eliminate or at least substantially reduce the above-described vibrations which can occur in certain applications, namely those in which the heated liquid promotes conglomeration of enlarged steam bubbles before condensation. The structure of a heater 110 in accordance with the invention, FIGS. 2–5, is similar in many respects to the overall structure of the heater 10 shown in prior art FIG. 1, and similar reference numbers are used where appropriate. However, in accordance with the invention, the coaxial plug 30 and nozzle 20 configuration in the heater 10 shown in prior art FIG. 1 is replaced with a Mach diffuser 112 having a plurality of radial steam diffusion holes 134 and an adjustably positionable cover 116.

Figure 2:
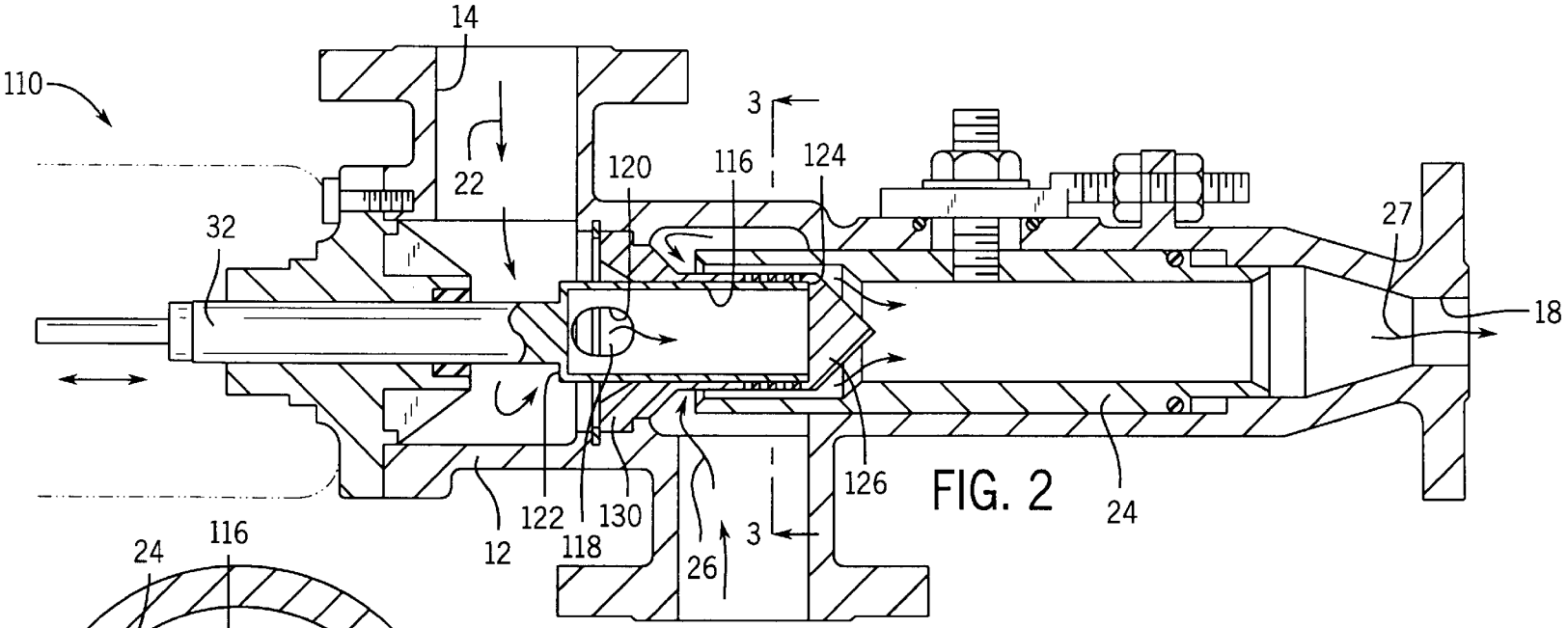
FIG. 2 is a side elevational view showing a longitudinal cross-section of the direct contact steam injection heater including a Mach diffuser having a plurality of radial steam diffusion holes in accordance with the invention.

In the heater 110 shown in FIG. 2, steam 22 flows into the heater 110 through steam inlet 14, and then flows into an internal region 118 within the cover 116 through opening 120. The cover 116 is a cylindrical wall having a closed top 122 and an open bottom 124. Steam is supplied to the Mach diffuser 112 through the cover 116 via opening 120, internal region 118, and open bottom 124 at essentially the full steam pressure available to the heater 110.

The Mach diffuser 112 preferably includes a cone-shaped cap 126, a cylindrical wall 128, and a concentric diffuser base 130. An internal region resides in the Mach diffuser 112 within the cap 126, the cylindrical wall 128, and the base 130. The cover 116, FIG. 2, is preferably contained within the internal region in the Mach diffuser 112.

Figure 4:
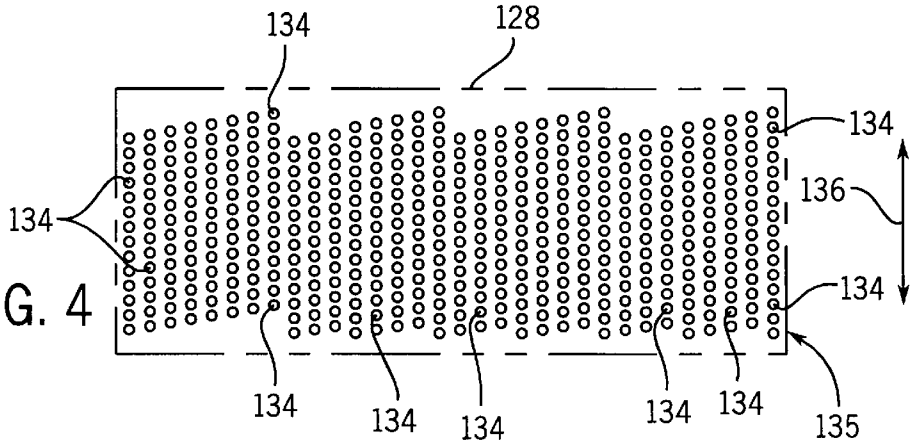
FIG. 4 is a detailed view of the preferred embodiment of a Mach diffuser used to implement the invention as taken in accordance with line 4—4 in FIG. 3.
Figure 3:
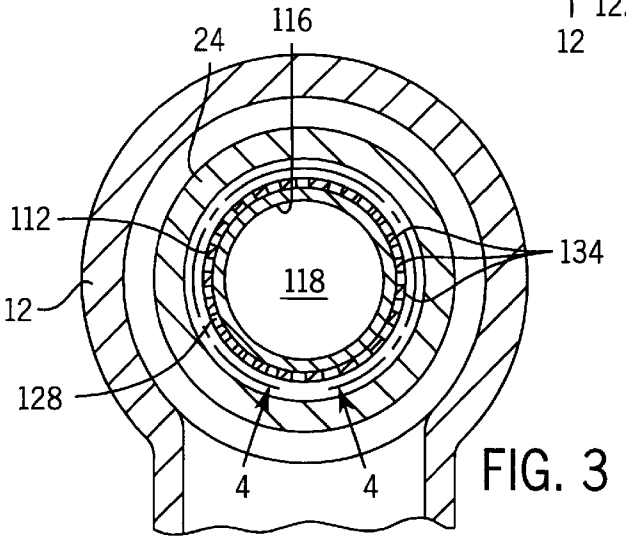
FIG. 3 is a sectional view taken along line 3—3 in FIG. 2.

As illustrated in FIGS. 3 and 4, the cylindrical wall 128 of the Mach diffuser 112 includes a plurality of radial steam diffusion holes 134. The size and number of the steam diffusion holes is a matter of choice depending on the size of the heater 110, however, a diameter of about 1/16 of an inch is preferred for most applications. Such a diameter is sufficiently small to facilitate the creation of relatively small radial jets of steam through the diffuser wall 128, yet is not so small as to create other problems such as plugging or scaling due to the liquid characteristics. In addition, it is preferred that the Mach diffuser 112 be made of stainless steel, and that the cylinder wall 128 have thickness sufficient to avoid premature deterioration as steam passes through the plurality of steam diffusion holes 134 over extended periods of time.

The plurality of steam diffusion holes 134 are arranged at least in part longitudinally (arrow 136) along the cylinder wall 128. In this manner, the amount of steam supplied through the Mach diffuser 112 into the liquid 26 flowing through the combining tube 24 can be easily modulated by moving the adjustably positionable cover 116 to expose a selected number of steam diffusion holes 134. The pattern of steam diffusion holes 134 in the Mach diffuser 112 as shown in FIG. 4 includes columns of steam diffusion holes 134 in the axial direction 136, and the rows of steam diffusion holes 134 are slanted. The purpose of the slant is to smooth the change of total flow area through the steam diffusion holes 134 as the cover 116 is to move linearly within the Mach diffuser 112. Note that the concentric diffuser base 130 and the cone-shaped cap 126 are solid, and therefore steam does not pass through the base 130 and cap 126. The density of steam diffusion holes 134 through the cylindrical wall 128 is less along the portion 135 of the wall 128 near the diffuser cap 126 than along the remaining portion of the cylinder wall 128. This is preferred to improve the resolution of steam modulation at very low steam flow rates.

Figure 5:
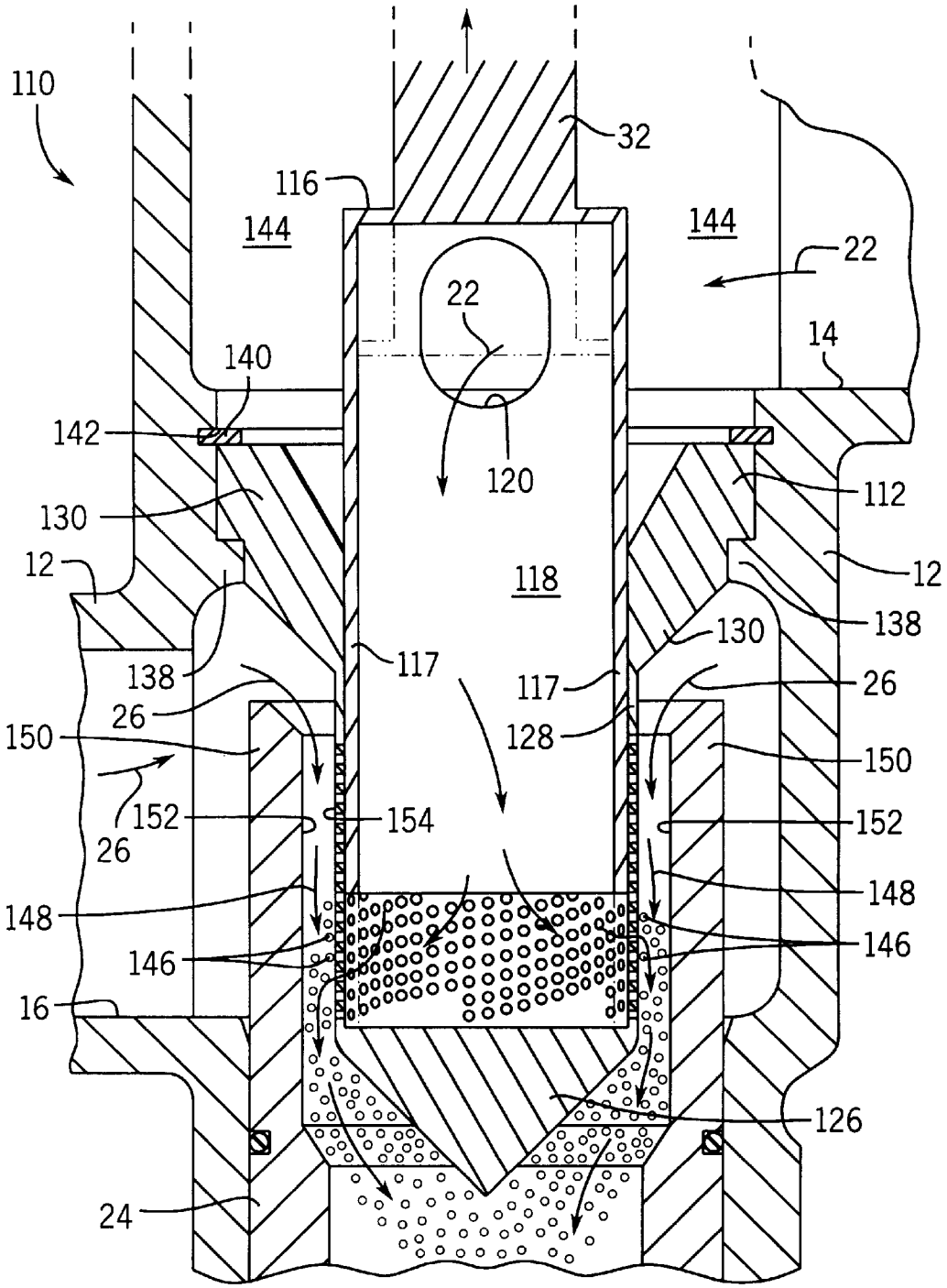
FIG. 5 is a detailed schematic view of the mixing of steam and liquid in a direct contact steam injection heater including a Mach diffuser having a plurality of radial steam diffusion hole.

Referring now to FIG. 5, the Mach diffuser 112 is connected to the heater body 12 by placing the concentric diffuser base 130 on an inwardly extending support step 138, and engaging a snap ring 140 into a groove 142 in the heater body 112 to secure the Mach diffuser 112 in place within the heater 110. The cover 116 has a solid cylindrical wall 117 that is slidably mounted within the cylindrical wall 128 of the Mach diffuser 112. Steam 22 thus flows from the heater inlet 14 into a steam cavity 144 within the heater and into the cover 116 through opening 120. The solid concentric Mach diffuser base 130 prevents steam from flowing from steam cavity 144 in the heater 110 into the flow of liquid 26 through the combining region 24 without passing through the Mach diffuser 112. In FIG. 5, the cover 116 is shown in an open position (solid lines), and alternatively in a fully closed position (in phantom). When the cover 116 is fully closed, the cylindrical wall 117 of the cover 116 covers all of the steam diffusion holes 134 in the diffuser wall 128 and no steam 22 is allowed to flow through the Mach diffuser 128 into the flow of liquid 26 through the combining region 24.

When the cover 116 is moved to an open position (solid lines), steam 22 within the internal region 118 of the cover 116 is allowed to flow through the exposed steam diffusion holes 134 in the cylindrical wall 128 of the Mach diffuser 112. Steam flows radially through the respective steam diffusion holes 134 to form high velocity radial jets 146 of steam 22 in the axial flow 148 of liquid 26 through the channel between the cylindrical wall 128 of the Mach diffuser 112 and the upper end 150 of the combining region 24.

As depicted in FIG. 2, the combining region may take the form of an adjustably positionable combining tube 24. The position of the combining tube and consequently the position of the upper end 150 of the combining tube 24 is selected to optimize the shear and flow rate of liquid 26 through the heater 110. The positioning of the combining tube 150 can be fixed as is known in the art, or can be adjustable as disclosed in U.S. patent application Ser. No. 08/650,648, entitled "Adjustable Shear Direct Contact Steam Injection Heater", by Brian N. Drifka and Bruce A. Cincotta, filed on May 20, 1996, now U.S. Pat. No. 5,842,497, incorporated herein by reference. Alternatively, the invention can be carried in a heater in which the combining region is not an adjustably positionable combining tube. For example, see above incorporated U.S. Pat. No. 5,622,655 entitled "Sanitary Direct Contact Steam Injection Heater Method", by Bruce Cincotta et al. issuing on Apr. 22, 1997, which shows a combining region integral with the heater body.

Referring again to FIG. 5, the cylindrical wall 128 and end cap 126 of the Mach diffuser 112 are located within the upper end 150 of the combining tube 24 such that the small jets of steam 146 are discharged radially into the flow of liquid 26 as the liquid is flowing through the combining region 24. The width of the channel for liquid 26 flowing between the Mach diffuser 112 and the wall 152 of the combining region 24 should be selected to optimize the axial velocity of liquid 26 flowing through the channel for enhanced mixing. It is desired that the axial velocity of the liquid be sufficient to continually wet the outer surface 154 of the cylindrical wall 128 of the Mach diffuser, thus eliminating the likelihood that continuous large bubbles will generate from the small radial jets of steam 146 into the axial flow of liquid 148. The preferred width of the channel between the Mach diffuser 112 and the inner wall 152 of the combining region 24 depends on the size of the heater 110, and on the type of liquid 26 being heated, and the amount of steam 22 being added, but it has been found that a channel width providing axial velocities in the range of 20 to 30 feet per second has been effective for reducing heater 110 vibrations.

The steam pressure within the Mach diffuser 112 is sufficient so that the radial flow through the steam diffusion holes 134 is choked flow. Therefore, as long as there is a sufficient pressure drop across the respective steam diffusion holes 134, the flow of steam 22 into the liquid 26 will remain stable, and the flow rate of steam will be defined by the steam pressure and the accumulated flow area of the exposed steam diffusion holes 134. The amount of steam 22 added to the liquid 26 can therefore be precisely modulated by properly positioning the cover 116 within the diffuser 112 to expose the proper amount of steam diffusion holes 134.

The radial jets 146 of high velocity steam 22 shear the high velocity axial flow of liquid 148 in the channel between the Mach diffuser 112 and the inner wall 152. The mixture flows axially downstream past the cone-shaped Mach diffuser end cap 126 into the combining region 24 to continue heat transfer and condensation of the steam. It is preferred that the end cap 126 be cone-shaped in order to facilitate smooth fluid flow through the heater 110, although it is not necessary that the end cap 126 be cone-shaped.

With the invention as described in FIGS. 2–5, steam bubbles within the combining region 24 remain relatively small and therefore steam condensation within the combining region 24 does not cause substantial vibrations even when heating difficult liquids (e.g. liquids having relatively small numbers of nucleation points, or liquids having insufficient surface tension).

While the preferred embodiment of the invention has been shown in connection with FIGS. 2–5, it should be noted that the invention is not limited to this specific embodiment. For instance, while the drawings show a Mach diffuser 112 having a fixed position with respect to the heater 110 and an axially positionable cover 116, there are other ways to vary the number of steam diffusion holes that are exposed. These other ways should be considered to fall within the scope of the invention. Further, while it is desirable for the steam jets to flow radially into the axial flow of liquid, other arrangements may be possible in which the steam does not flow radially into the axial flow of liquid. These and other alternatives and modifications which do not depart from the true spirit of the invention are possible and should be considered to fall within the scope of the following claims.

We claim:

1. A direct contact steam injection heater comprising:

a heater body having a steam inlet, a liquid inlet, a combining region and a heated liquid discharge outlet;

the combining region having an inlet and an outlet located within the heater body in which steam and liquid are combined to generate heated liquid;

a Mach diffuser that receives the flow of steam into the heater body and discharges the steam into the liquid flowing through the combining region, wherein a coaxial channel is located between the Mach diffuser and an inlet portion of the combining region of the heater body and the Mach diffuser contains a plurality of steam diffusion holes through which the steam is discharged into the liquid flowing through the channel between the Mach diffuser and the inlet portion of the combining region; and an adjustably positionable cover over the steam diffusion holes contained in the Mach diffuser that is movable relative to the Mach diffuser to adjustably expose one or more of the steam diffusion holes in the Mach diffuser and modulate the amount of steam discharged through the Mach diffuser into the liquid flowing through the combining region;

wherein:

the steam pressure upstream of the Mach diffuser is sufficient to create sonic choked flow conditions through the exposed diffusion holes through which steam is discharged from the Mach diffuser into the flow of liquid flowing through the channel between the Mach diffuser and the inlet portion of the combining region;

the coaxial channel has a flow area substantially less than a flow are of a downstream portion of the combining region in which the injected steam condenses; and liquid flows through the inlet portion and the downstream portion of the combining region in an axial direction and steam flows in generally radial directions as the steam flows through the one or more steam diffusion holes in the Mach diffuser into the axial liquid flow through the channel between the Mach diffuser and the combining region of the heater body.

2. A direct contact steam injection heater as recited in claim 1 wherein:

the Mach diffuser includes a wall containing the plurality of steam diffusion holes which are arranged at least in part longitudinally along the wall; and the adjustably positionable cover comprises a solid wall having an internal region that contains steam passing into the heater through the steam inlet and a steam opening that enables steam to flow from the internal region within the cover wall and through the exposed one or more steam diffusion holes in the Mach diffuser into the flow of liquid through the channel between the Mach diffuser and the inlet portion of the combining region of the heater body.

3. A direct contact steam injection heater as recited in claim 2 wherein the steam outlet in the cover wall is provided at a discharge end of the cover.

4. A direct contact steam injection heater as recited in claim 1 wherein the adjustably positionable cover also comprises a steam inlet provided at an upstream end of the cover.

5. A direct contact steam injection heater as recited in claim 2 wherein the wall of the Mach diffuser containing the plurality of steam diffusion holes is cylindrical and the solid wall of the adjustably positionable cover is cylindrical.

6. A direct contact steam injection heater as recited in claim 1 wherein the adjustably positionable cover is part of an adjustably positionable stem assembly which includes a longitudinal stem connected to an upstream end of the adjustably positionable cover, the stem projecting generally axially away from a cap on the upstream end of the adjustably positionable cover.

7. A direct contact steam injection heater as recited in claim 6 further comprising a linear actuator that is physically connected to the longitudinal stem and moves the adjustably positionable cover to modulate the amount of steam discharged through the Mach diffuser into liquid flowing through the channel between the Mach diffuser and the combining region of the heater body.

8. A direct contact steam injection heater as recited in claim 2 wherein the cover wall is located within the Mach diffuser.

9. A direct contact steam injection heater as recited in claim 1 wherein the plurality of diffusion holes through the Mach diffuser are distributed relative to the adjustably positionable cover such that a generally proportional amount of steam diffusion holes are exposed in relation to the stroke of the cover.

10. A direct contact steam injection heater as recited in claim 9 wherein the stroke of the adjustably positionable cover ranges from a fully closed position in which no steam diffusion holes through the Mach diffuser are exposed and a fully open position wherein a maximum number of steam diffusion holes through the Mach diffuser are exposed.

11. A direct contact steam injection heater as recited in claim 10 wherein the steam diffusion holes through the Mach diffuser are arranged such that the density of steam diffusion holes exposed when the cover is positioned within an initial portion of the stroke adjacent the closed position is less than the density of steam diffusion holes through the Mach diffuser along other portions of the stroke of the cover.

12. A direct contact steam injection heater as recited in claim 1 wherein the Mach diffuser comprises:

a longitudinal cylinder having a longitudinal cylindrical wall containing the plurality of steam diffusion holes;

a solid end cap that covers the downstream end of the Mach diffuser cylinder exposed to liquid flowing through the combining region; and a concentric diffuser base attached to the cylinder wall of the Mach diffuser and connecting the Mach diffuser to the heater body.

13. A direct contact steam injection heater as recited in claim 1 wherein the Mach diffuser is rigidly affixed to the heater and the cover is movable with respect to the Mach diffuser to enable modulation of the amount of steam discharged through the Mach diffuser into the liquid flowing through the channel between the Mach diffuser and the combining region of the heater body.

14. A direct contact steam injection heater as recited in claim 1 wherein the relative flow area of the channel between the Mach diffuser and the inlet portion of the combining region is such that the axial velocity of liquid flowing through the channel is sufficient to continually wet an outer surface of the Mach diffuser.

15. A direct contact steam injection heater as recited in claim 1 wherein the relative flow area of the channel between the Mach diffuser and the inlet portion of the combining region is selected so that the axial velocity of liquid flowing through the channel is within the range of 20 feet per second to 30 feet per second.

16. A direct contact steam injection heater comprising:

a heater body having a steam inlet, a liquid inlet, a combining region and a heated liquid discharge outlet;

the combining region having an inlet and an outlet located within the heater body in which steam and liquid are combined to generate heated liquid;

a Mach diffuser that receives the flow of steam into the heater body and discharges the steam into the liquid flowing through the combining region, wherein a coaxial channel is located between the Mach diffuser and an inlet portion of the combining region of the heater body and the Mach diffuser contains a plurality of steam diffusion holes through which the steam is discharged into the liquid flowing through the channel between the Mach diffuser and the inlet portion of the combining region; and an adjustably positionable cover over the steam diffusion holes contained in the Mach diffuser that is movable relative to the Mach diffuser to adjustably expose one or more of the steam diffusion holes in the Mach diffuser and modulate the amount of steam discharged through the Mach diffuser into the liquid flowing through the combining region;

wherein:

the steam pressure upstream of the Mach diffuser is sufficient to create sonic choked flow conditions through the exposed diffusion holes through which steam is discharged from the Mach diffuser into the flow of liquid flowing through the channel between the Mach diffuser and the inlet portion of the combining region;

the coaxial channel has a flow area substantially less than a flow area of a downstream portion of the combining region in which the injected steam condenses; and the relative flow area of the channel between the Mach diffuser and the inlet portion of the combining region is selected so that the axial velocity of liquid flowing through the channel is within the range of 20 feet per second to 30 feet per second.

17. A direct contact steam injection heater as recited in claim 16 wherein:

the Mach diffuser includes a wall containing the plurality of steam diffusion holes which are arranged at least in part longitudinally along the wall; and the adjustably positionable cover comprises a solid wall having an internal region that contains steam passing into the heater through the steam inlet and a steam opening that enables steam to flow from the internal region within the cover wall and through the exposed one or more steam diffusion holes in the Mach diffuser into the flow of liquid through the channel between the Mach diffuser and the inlet portion of the combining region of the heater body.

18. A direct contact steam injection heater as recited in claim 17 wherein the steam outlet in the cover wall is provided at a discharge end of the cover.

19. A direct contact steam injection heater as recited in claim 16 wherein the adjustably positionable cover also comprises a steam inlet provided at an upstream end of the cover.

20. A direct contact steam injection heater as recited in claim 17 wherein the wall of the Mach diffuser containing the plurality of steam diffusion holes is cylindrical and the solid wall of the adjustably positionable cover is cylindrical.

21. A direct contact steam injection heater as recited in claim 16 wherein liquid flows through the inlet portion and the downstream portion of the combining region in an axial direction and steam flows in generally radial directions as the steam flows through the one or more steam diffusion holes in the Mach diffuser into the axial liquid flow through the channel between the Mach diffuser and the combining region of the heater body.

22. A direct contact steam injection heater as recited in claim 16 wherein the adjustably positionable cover is part of an adjustably positionable stem assembly which includes a longitudinal stem connected to an upstream end of the adjustably positionable cover, the stem projecting generally axially away from a cap on the upstream end of the adjustably positionable cover.

23. A direct contact steam injection heater as recited in claim 22 further comprising a linear actuator that is physically connected to the longitudinal stem and moves the adjustably positionable cover to modulate the amount of steam discharged through the Mach diffuser into liquid flowing through the channel between the Mach diffuser and the combining region of the heater body.

24. A direct contact steam injection heater as recited in claim 17 wherein the cover wall is located within the Mach diffuser.

25. A direct contact steam injection heater as recited in claim 16 wherein the plurality of diffusion holes through the Mach diffuser are distributed relative to the adjustably positionable cover such that a generally proportional amount of steam diffusion holes are exposed in relation to the stroke of the cover.

26. A direct contact steam injection heater as recited in claim 25 wherein the stroke of the adjustably positionable cover ranges from a fully closed position in which no steam diffusion holes through the Mach diffuser are exposed and a fully open position wherein a maximum number of steam diffusion holes through the Mach diffuser are exposed.

27. A direct contact steam injection heater as recited in claim 26 wherein the steam diffusion holes through the Mach diffuser are arranged such that the density of steam diffusion holes exposed when the cover is positioned within an initial portion of the stroke adjacent the closed position is less than the density of steam diffusion holes through the Mach diffuser along other portions of the stroke of the cover.

28. A direct contact steam injection heater as recited in claim 16 wherein the Mach diffuser comprises:

a longitudinal cylinder having a longitudinal cylindrical wall containing the plurality of steam diffusion holes;

a solid end cap that covers the downstream end of the Mach diffuser cylinder exposed to liquid flowing through the combining region; and a concentric diffuser base attached to the cylinder wall of the Mach diffuser and connecting the Mach diffuser to the heater body.

29. A direct contact steam injection heater as recited in claim 16 wherein the Mach diffuser is rigidly affixed to the heater and the cover is movable with respect to the Mach diffuser to enable modulation of the amount of steam discharged through the Mach diffuser into the liquid flowing through the channel between the Mach diffuser and the combining region of the heater body.

* * * * *

UNITED STATES PATENT AND TRADEMARK OFFICE

CERTIFICATE OF CORRECTION

PATENT NO. : 6,082,712
DATED : July 4, 2000
INVENTOR(S) : Bruce A. Cincotta and Damon L. Fisher It is certified that error appears in the above-identified patent and that said Letters Patent is hereby corrected as shown below:

Claim 24, Column 10,
Line 17, delete "claim 17" and substitute therefor -- claim 18 --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*